US009238575B2

(12) United States Patent
Guido

(10) Patent No.: US 9,238,575 B2
(45) Date of Patent: Jan. 19, 2016

(54) ICE LUGE APPARATUS, SYSTEMS, AND METHODS FOR CHILLED BEVERAGE DISPENSING

(71) Applicant: Michael Guido, Smithtown, NY (US)

(72) Inventor: Michael Guido, Smithtown, NY (US)

( * ) Notice: Subject to any disclaimer, the term of this patent is extended or adjusted under 35 U.S.C. 154(b) by 146 days.

(21) Appl. No.: 13/771,290

(22) Filed: Feb. 20, 2013

(65) Prior Publication Data

US 2013/0221031 A1 Aug. 29, 2013

Related U.S. Application Data

(60) Provisional application No. 61/602,198, filed on Feb. 23, 2012.

(51) Int. Cl.

| | |
|---|---|
| ***B67D 7/80*** | (2010.01) |
| ***B67D 3/00*** | (2006.01) |
| ***F25C 1/22*** | (2006.01) |

(52) U.S. Cl.

CPC ..... *B67D 3/008* (2013.01); *B67D 3/0009* (2013.01); *F25C 1/22* (2013.01); *F25C 2400/06* (2013.01)

(58) Field of Classification Search

CPC ..... B67D 3/0009; F25C 2400/06; F25C 1/22
USPC ..... 222/146.6, 181.1; 62/389; D15/90
See application file for complete search history.

(56) References Cited

U.S. PATENT DOCUMENTS

| | | | | | |
|---|---|---|---|---|---|
| 1,928,594 | A * | 9/1933 | Kearney | F25C 5/18 | 211/128.1 |
| 2,716,871 | A * | 9/1955 | Brown | 62/293 | |
| 3,171,573 | A * | 3/1965 | Berney | 222/183 | |
| 4,550,575 | A * | 11/1985 | DeGaynor | A47G 23/04 | 248/153 |
| 5,377,878 | A * | 1/1995 | Rainey et al. | 222/146.6 | |
| 5,419,856 | A * | 5/1995 | Shaw | A23G 9/44 | 249/149 |
| 5,444,992 | A * | 8/1995 | Bell | 62/372 | |
| 5,651,254 | A * | 7/1997 | Berry | F25C 1/22 | 62/1 |
| 5,967,322 | A * | 10/1999 | Apps et al. | 206/497 | |
| 6,095,372 | A * | 8/2000 | Dorsey et al. | 222/105 | |
| 6,123,226 | A * | 9/2000 | Giattino et al. | 222/2 | |
| 6,337,044 | B1 * | 1/2002 | Wang | B22C 9/106 | 164/132 |
| 6,763,675 | B1 * | 7/2004 | Fleeman | 62/386 | |
| 2009/0115109 | A1 * | 5/2009 | Albright | 264/334 | |
| 2010/0218517 | A1 * | 9/2010 | Luther | 62/66 | |
| 2010/0281909 | A1 * | 11/2010 | Carpanzano | 62/386 | |

* cited by examiner

*Primary Examiner* — Daniel R Shearer

(74) *Attorney, Agent, or Firm* — Carter, DeLuca, Farrell & Schmidt, LLP

(57) ABSTRACT

Improved ice luge trays and methods for use and assembly thereof. The ice luge trays include a trough and a lid that fits above the trough. The trough, with the lid disposed thereon, is configured to be filled with water and placed in a freezer to form an ice block. The lid includes features that forms a channel extending along or through the ice block. The tray is mounted on a support structure to enable a beverage to be chilled as it flows down the channel under gravity, and delivered to a drinking vessel or directly into the mouth of a user.

17 Claims, 11 Drawing Sheets

ICE LUGE APPARATUS, SYSTEMS, AND METHODS FOR CHILLED BEVERAGE DISPENSING

CROSS-REFERENCE TO RELATED APPLICATION

This application claims priority from, and the benefit of, U.S. Provisional Application Ser. No. 61/602,198, filed Feb. 23, 2012, the entirety of which is hereby incorporated by reference herein for all purposes.

BACKGROUND

1. Technical Field

The present disclosure relates to chilled beverage dispensing and, more particularly, to apparatus, systems, and methods relating to ice luges for chilled beverage dispensing.

2. Description of Related Art

Ice luges are commonly used at celebrations, parties, and other events to provide an entertaining way to rapidly chill and dispense beverages to guests. Typically, an ice luge consists of one or more large blocks of ice including one or more channels carved or otherwise formed within the ice block(s) in various different patterns or configurations. The ice block (s) is configured or positioned such that a liquid entering the input flows through the channels under gravity, ultimately exiting an output of the ice block(s). In use, a serving of a desired beverage is poured into the input, while the user places his/her mouth adjacent the output, awaiting the travel of the beverage through the channels and, ultimately, into the user's mouth. As the beverage travels through the channels formed within the ice block(s), the beverage is chilled such that, by the time the beverage reaches the output, it is sufficiently chilled for consumption.

SUMMARY

The present disclosure relates to apparatus, systems, and methods relating to ice luges for chilled beverage dispensing.

In accordance with embodiments of the present disclosure, a modular ice luge system and methods of use and assembly thereof are provided. The system generally includes at least one ice luge tray and a support frame for engaging and retaining the ice luge tray in a desired configuration.

In accordance with embodiments of the present disclosure, ice luge trays and methods for the use and assembly thereof are provided. The ice luge trays include a trough and a lid that fits about the trough. The trough, with the lid disposed thereon, is configured to be filled with water and placed in a freezer to form an ice block within the trough that has a channel extending therethrough.

In embodiments, the ice luge trays include features configured to inhibit movement of the ice block within the trough.

In embodiments, the lid is configured to snap-fit into engagement with the trough.

In embodiments, spouts are releasably engageable with the ice luge trays for sanitary purposes and to regulate the flow of beverage therethrough.

In embodiments, dispensing members are provided for collecting melted ice runoff in an idle configuration and for facilitating the dispensement of beverage from the ice luge tray to the user in a use configuration.

In embodiments, the ice luge trays include features to facilitate engagement with the support frame, spouts, and/or dispensing members configured for use therewith.

BRIEF DESCRIPTION OF THE DRAWINGS

Various illustrative embodiments of the present disclosure are described herein with reference to the drawing, wherein.

DETAILED DESCRIPTION

Figure 1:
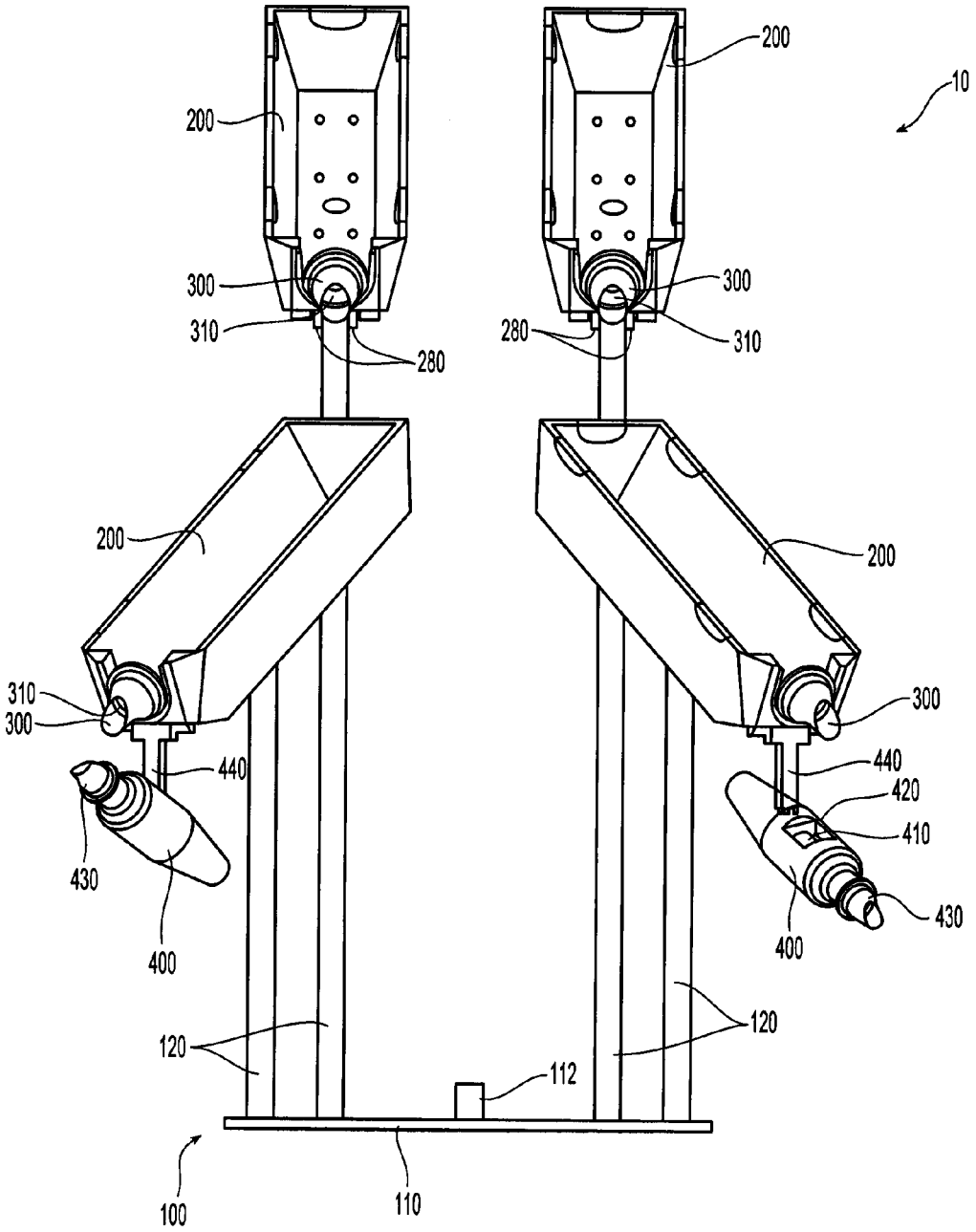
FIG. 1 is a front, perspective view of an ice luge system provided in accordance with the present disclosure.
Figure 2:
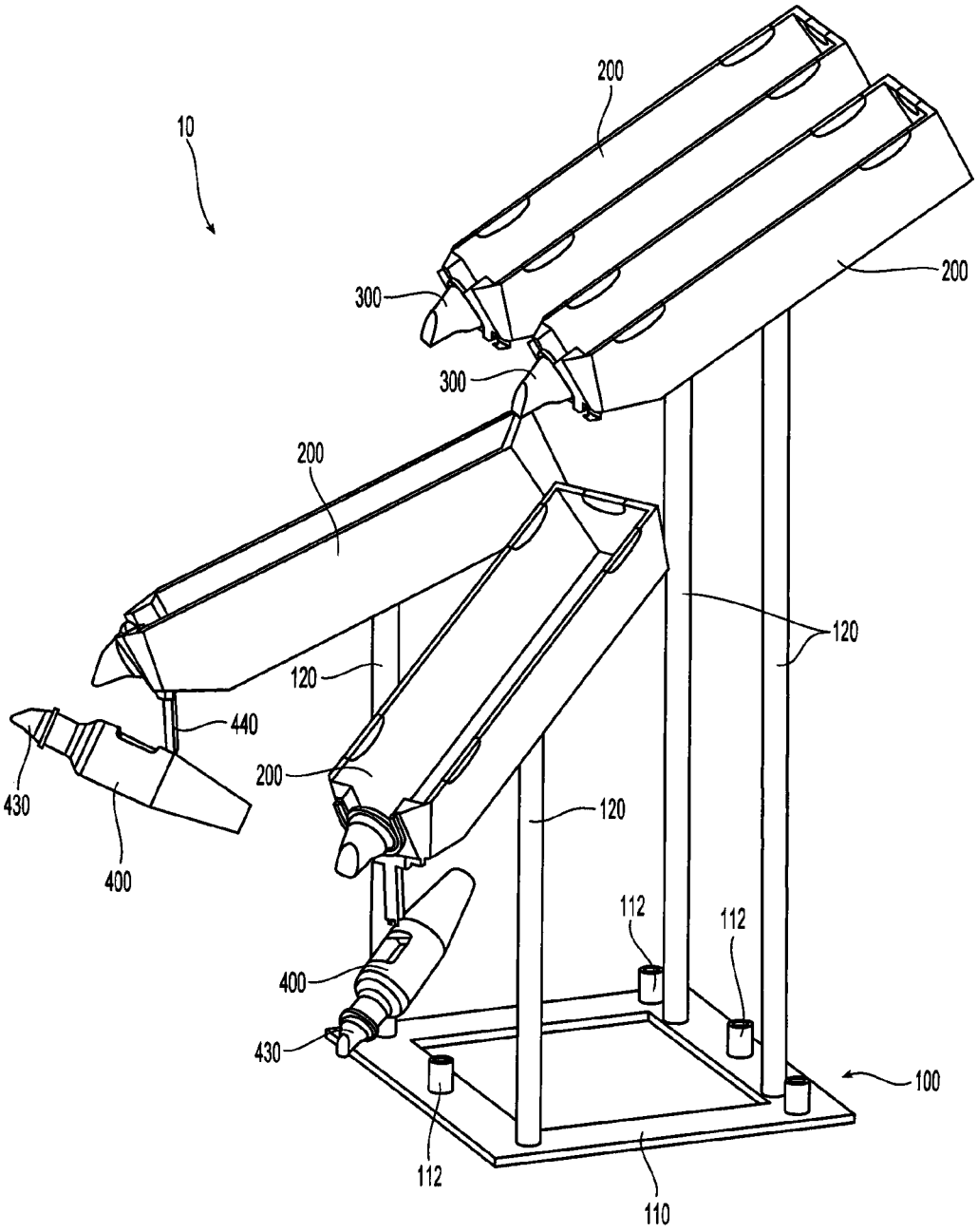
FIG. 2 is a first side, perspective view of the ice luge system of FIG. 1.
Figure 3:
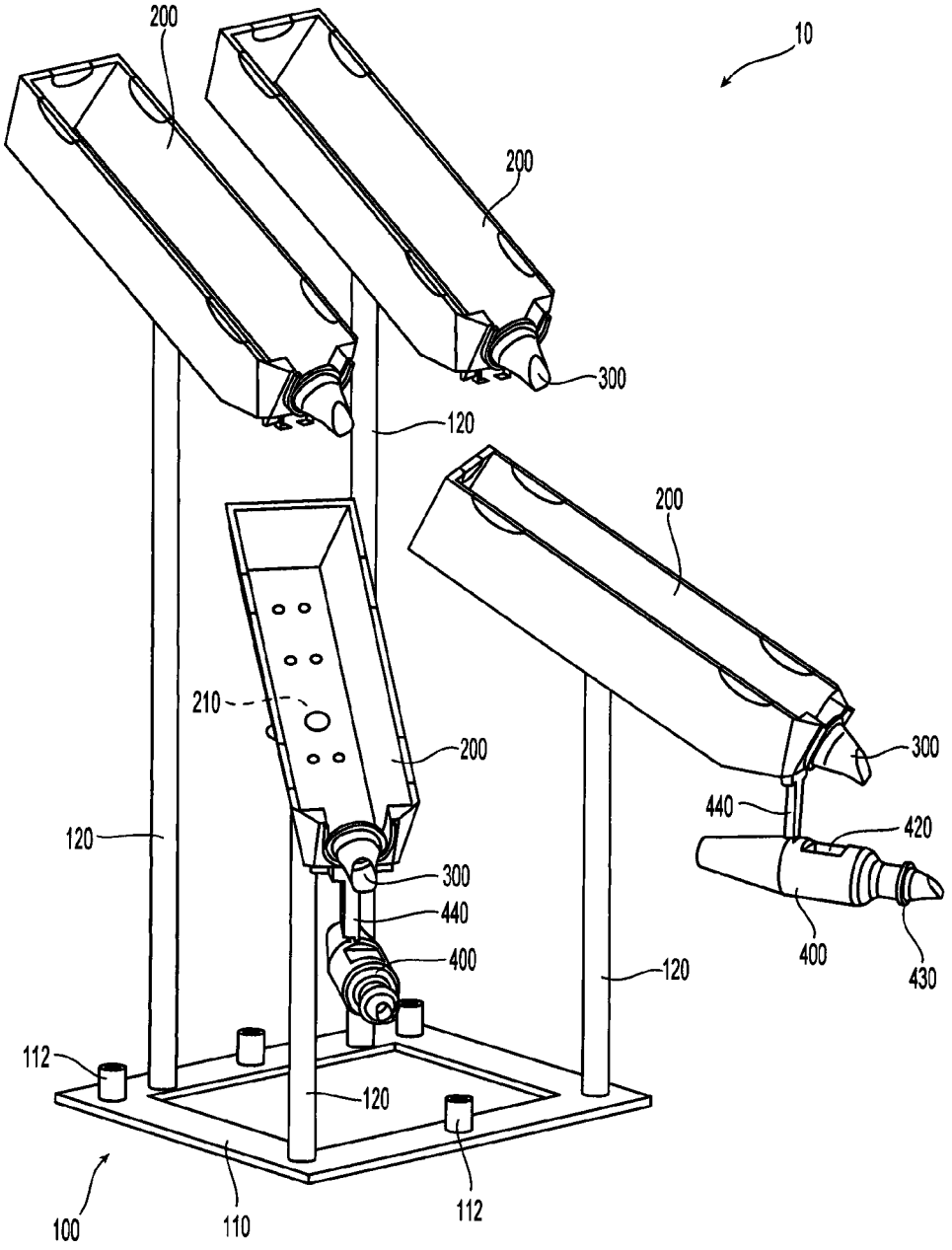
FIG. 3 is a second side, perspective view of the ice luge system of FIG. 1.
Figure 4:
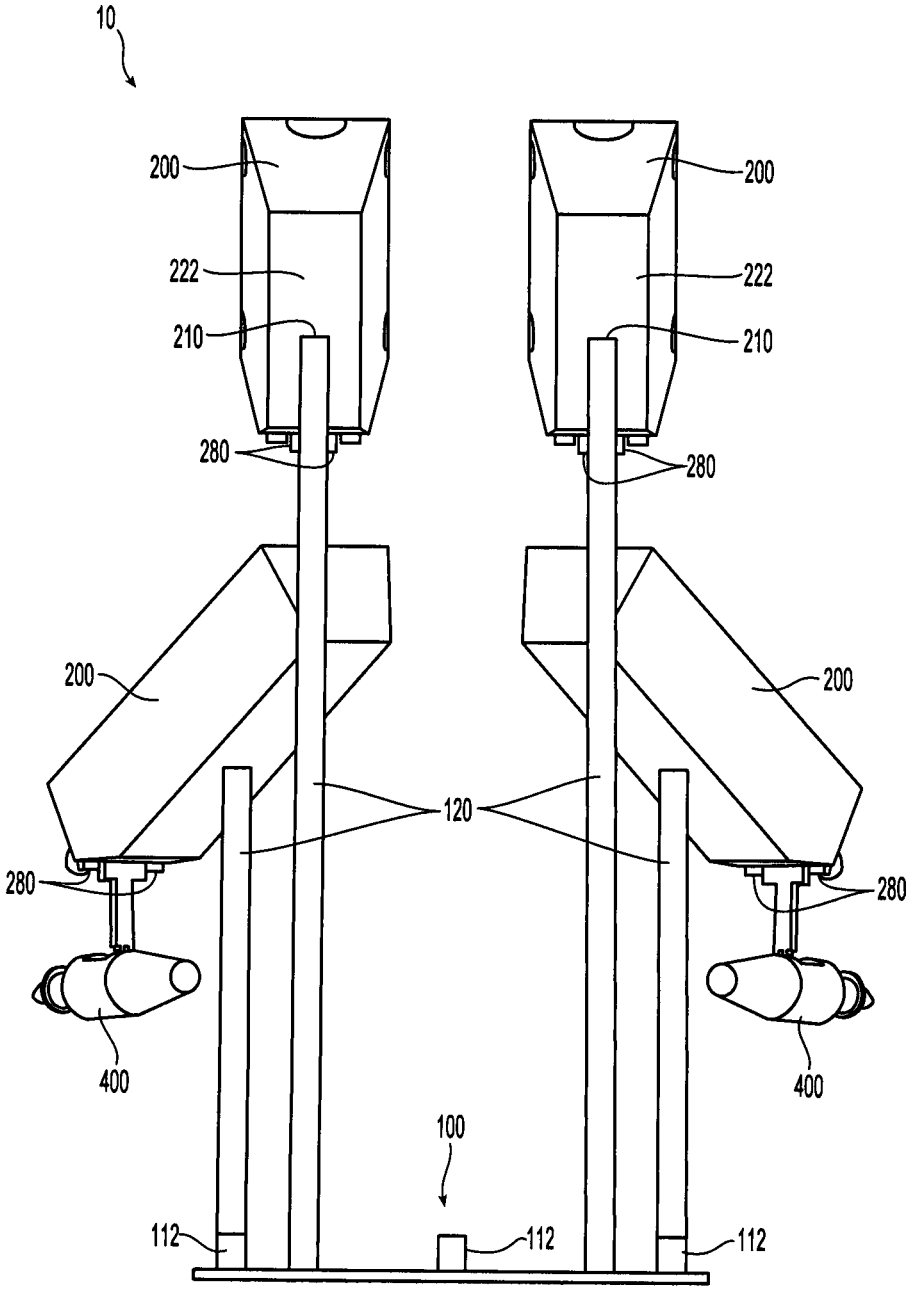
FIG. 4 is a rear, perspective view of the ice luge system of FIG. 1.

Referring to FIGS. 1-4, an ice luge system 10 provided in accordance with the present disclosure is shown generally including a support frame 100, a plurality of ice luge trays 200 each configured to retain an ice block therein, a plurality of spouts 300, and one or more dispensing members 400. Support frame 100 is configured for supporting the ice luge trays 200 in various different configurations and includes a base 110 having a plurality of supports 120 extending therefrom. Base 110 and supports 120 may be formed from any suitable material including wood, metal, plastic, etc. Each support 120 is configured to support an ice luge tray 200. More specifically, base 110 includes a plurality of engagement members 112, e.g., male engagement features, disposed at various positions about base 110 that are configured for insertion into supports 120 to releasably engage supports 120 to base 110 at one end thereof in any suitable fashion, e.g., in friction-fit, snap-fit, or other suitable engagement. The other end of each support 120 is configured for insertion into an engagement member 210, e.g., a female engagement feature, of an ice luge tray 200 to releasably engage the ice luge tray 200 to the support 120, e.g., in friction-fit, snap-fit, or other suitable engagement. Engagement members 210 may further be configured to pivotably engage ice luge trays 200 about supports 120 such that ice luge trays 200 may be angled at a desired pitch relative to supports 120 to permit the beverage to flow through the channels defined within the ice blocks at a desired flow rate. Although shown with a plurality of ice luge trays, it is contemplated that a system may be configured with a single tray.

With continued reference to FIGS. 1-4, engagement members 112 of base 110 may be arranged about base 110 in any suitable number and/or configuration. Further, supports 120 may be provided in various different lengths and/or configurations, e.g., straight, angled, or curved configurations, such that supports 120 may be selectively engaged to base 110 to achieve a desired configuration. That is, although ice luge system 10 is shown in FIGS. 1-4 in one particular configuration wherein ice luge system 10 includes two pairs of cascading ice luge trays 200, it is envisioned that any suitable number and/or configuration of ice luge trays 200 and supports 120 may be provided so long as a beverage poured into an upper ice luge tray 200 is permitted to flow under gravity through the channel(s) of the ice block(s) of one or more of ice luge trays 200 and, ultimately, into one or more of the dispensing members 400 (or directly into a user's mouth or suitable beverage container).

Figure 5:
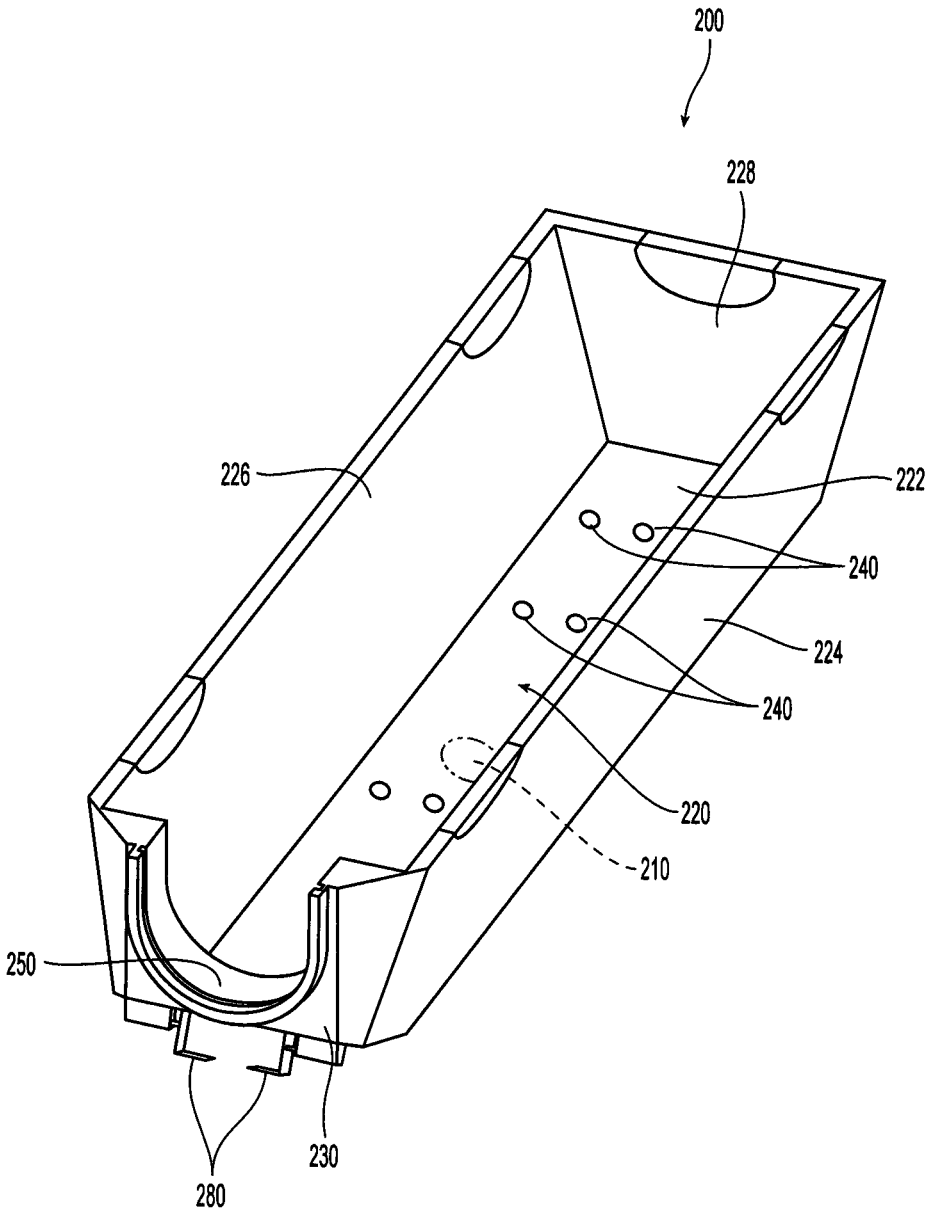
FIG. 5 is a front, perspective view of an ice luge tray configured for use with the ice luge system of FIG. 1.
Figure 6:
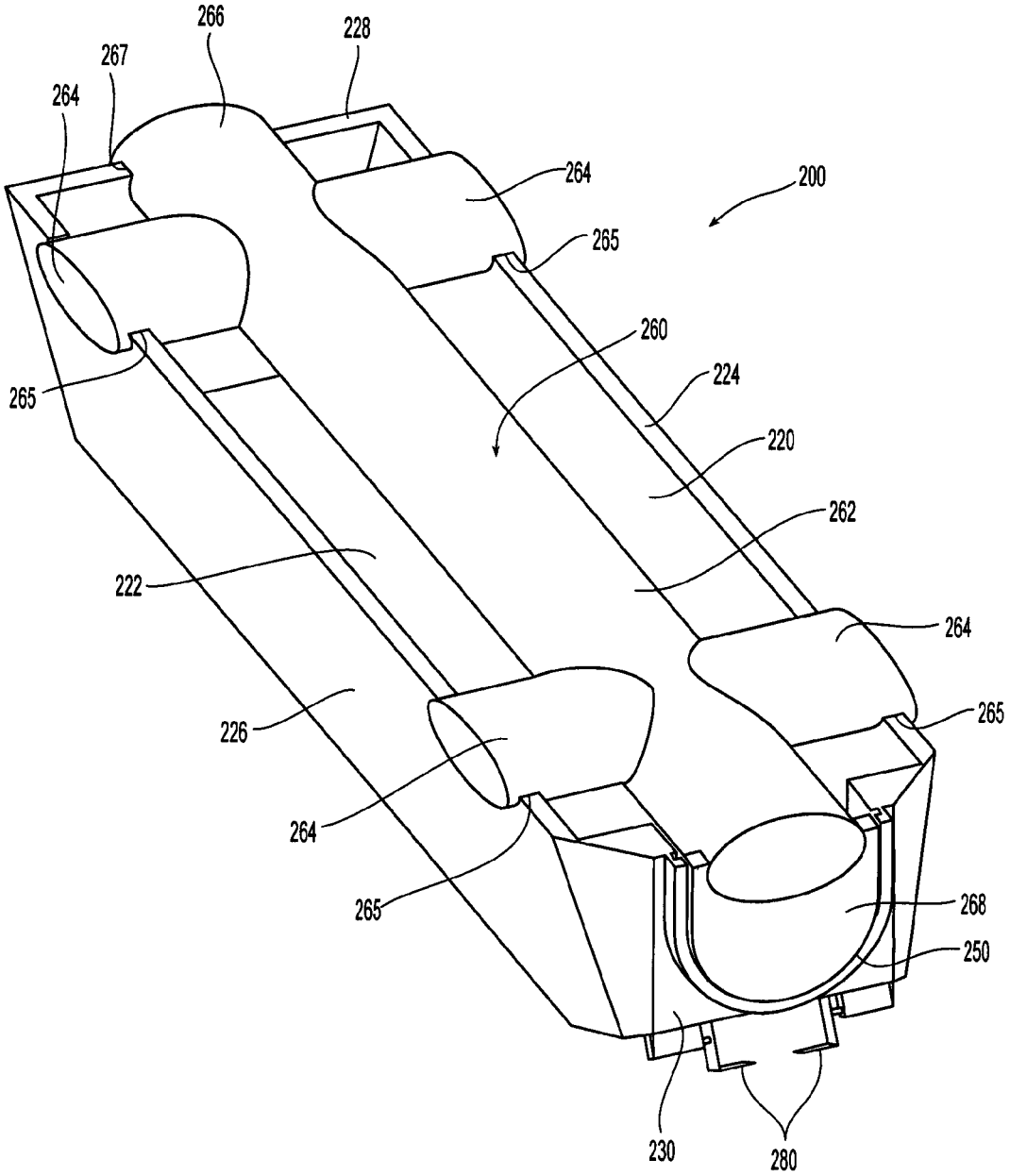
FIG. 6 is a front, perspective view of the ice luge tray of FIG. 5 including a cover engaged thereon.
Figure 7:
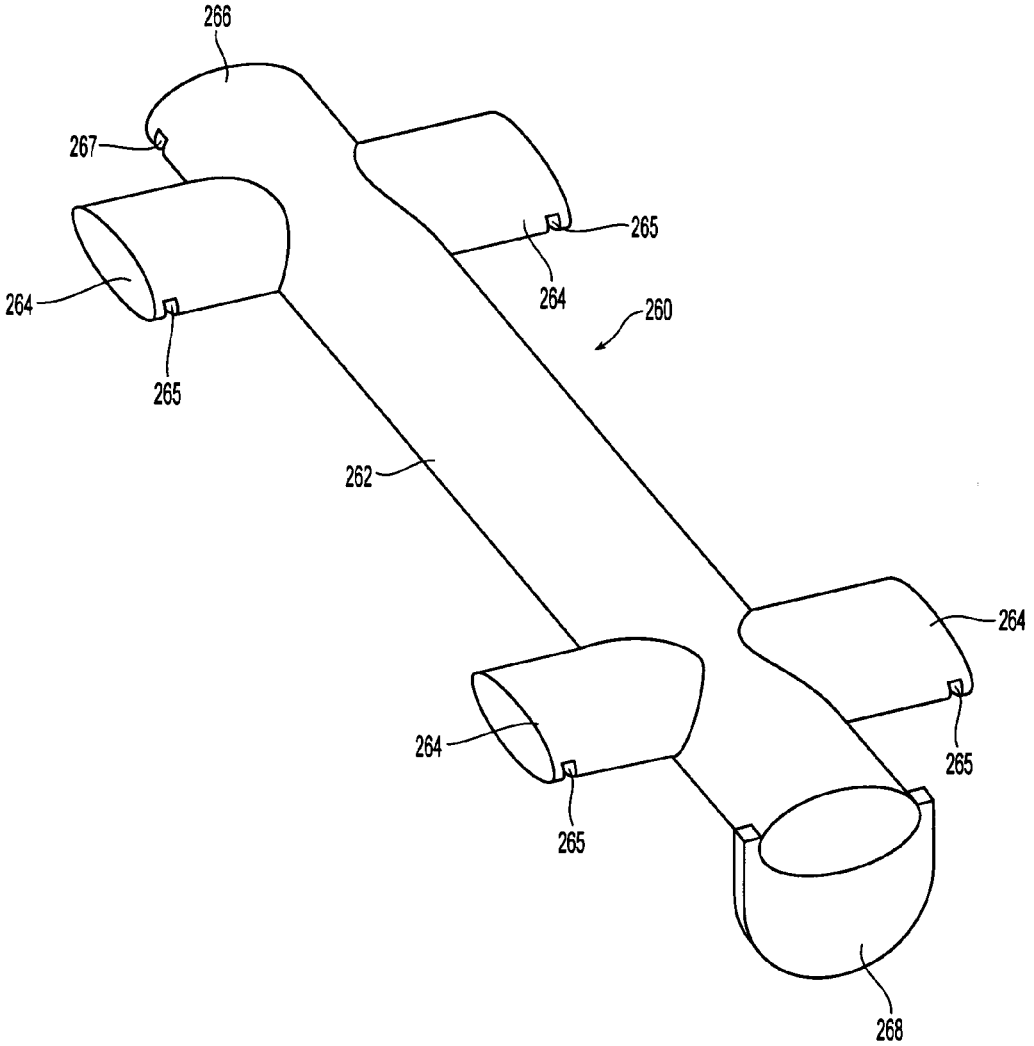
FIG. 7 is a front, perspective view of the cover of FIG. 6.

Turning now to FIGS. 5-7, in conjunction with FIGS. 1-4, an exemplary ice luge tray 200 is shown defining a generally trapezoidal configuration (although other outer configurations are contemplated) having a substantially flat bottom 222, first and second angled side walls 224, 226, a rear wall 228, and a front wall 230 that cooperate to define a trough 220. The trough 220 of the ice luge tray 200 (defined by the bottom 222, side walls 224, 226, rear wall 228, and front wall 230) is configured to be filled with water (or other suitable liquid) and placed in a freezer to allow the water to freeze to form a generally trapezoidal ice block contained within the trough 220 of the ice luge tray 200. Accordingly, it is envisioned that ice luge tray 200 be dimensioned and configured such that at least one ice luge tray 200 fits comfortably within a standard freezer. Also, it is contemplated that suitable freezable jells enclosed in an outer casing may also be used. These jells may be used multiple times. This permits use of the luge without diluting the beverage to be consumed.

The ice luge tray 200 is formed from any suitable material capable of withstanding temperatures typically encountered in a standard freezer and suitable for retaining beverages to be consumed, e.g., plastics, metal, composites, etc. or combinations thereof. The ice luge tray 200 may further include a plurality of protrusions 240 extending upwardly from the bottom 222 of the ice luge tray 200 and into the trough 220. Protrusions 240 are configured such that, once the ice block is formed within the trough 220 and about the protrusions 240, the protrusions 240 retain the ice block in position within the ice luge tray 200 and inhibit sliding or shifting of the ice block as the ice block begins to melt.

A semi-cylindrical cut-out 250 is defined within front wall 230 of ice luge tray 200, the importance of which will be described below. Other configurations of the cut-out 250 are also contemplated. Each ice luge tray 200, as mentioned above, also includes an engagement member 210 (FIG. 4) defined on an outer surface of the bottom 222 that releasably engages the ice luge tray 200 to one of the supports 120 (FIGS. 1-4).

With reference in particular to FIGS. 6-7, ice luge tray 200 includes a lid 260 configured for positioning about the open top portion of trough 220 of ice luge tray 200 to define a channel extending through the ice block as the water is frozen to form the ice block. That is, the lid 260 includes a generally cylindrical body 262 configured to extend at least partially into the interior of trough 220 prior to filling the trough 220 with water such that a semi-cylindrical channel is formed within the ice block once the water is frozen to from the ice block. Other configurations are also contemplated, e.g., the body 262 may define curved, angled, or other shape-configurations to thereby define correspondingly configured channels within the ice block. Further, the body 262 may be configured such that at least a portion of the body 262 is fully submergible within the water filling the trough 220 such that, upon formation of the ice block, a tunnel (rather than a channel) is formed through the ice block. In fact, multiple different lids 260 configured for use with ice luge tray 200 may be provided such that the user may select a desired lid 260 corresponding to a desired configuration of the channel(s) and/or tunnel(s) to be formed within the ice block. Regardless of the particular configuration of the lid 260, the body 262 of the lid 260, which defines the channel(s) and/or tunnel(s) obviates the need to chisel, blow torch, or otherwise form the channel within the ice block after the ice block has already been formed and allows for the formation of precise and/or complex features.

Lid 260 further includes a plurality of arms 264 extending laterally outwardly from either side thereof. Each arm 264 defines a slot 265 (or other suitable engagement feature) at the free end thereof that is configured for engagement, e.g., snap-fit engagement, about the adjacent side walls 224, 226 of ice luge tray 200 to maintain the lid 260 in position. Likewise, a rear portion 266 of body 262 of lid 260 defines a slot 267 for engaging rear wall 228 of ice luge tray 200. Body 262 of lid 260 further includes a neck portion 268 that extends therefrom for sealing engagement with cut-out 250 defined within the ice luge tray 200. Neck portion 268 and cut-out 250 cooperate to define an exit port formed in the ice block of the ice luge tray 200 that is disposed in communication with the channel defined through the ice block.

The configuration of lid 260 also permits multiple ice luge trays 200 to be stacked on top of one another in a freezer to facilitate simultaneous formation of multiple ice blocks within the several ice luge trays 200.

Figure 8:
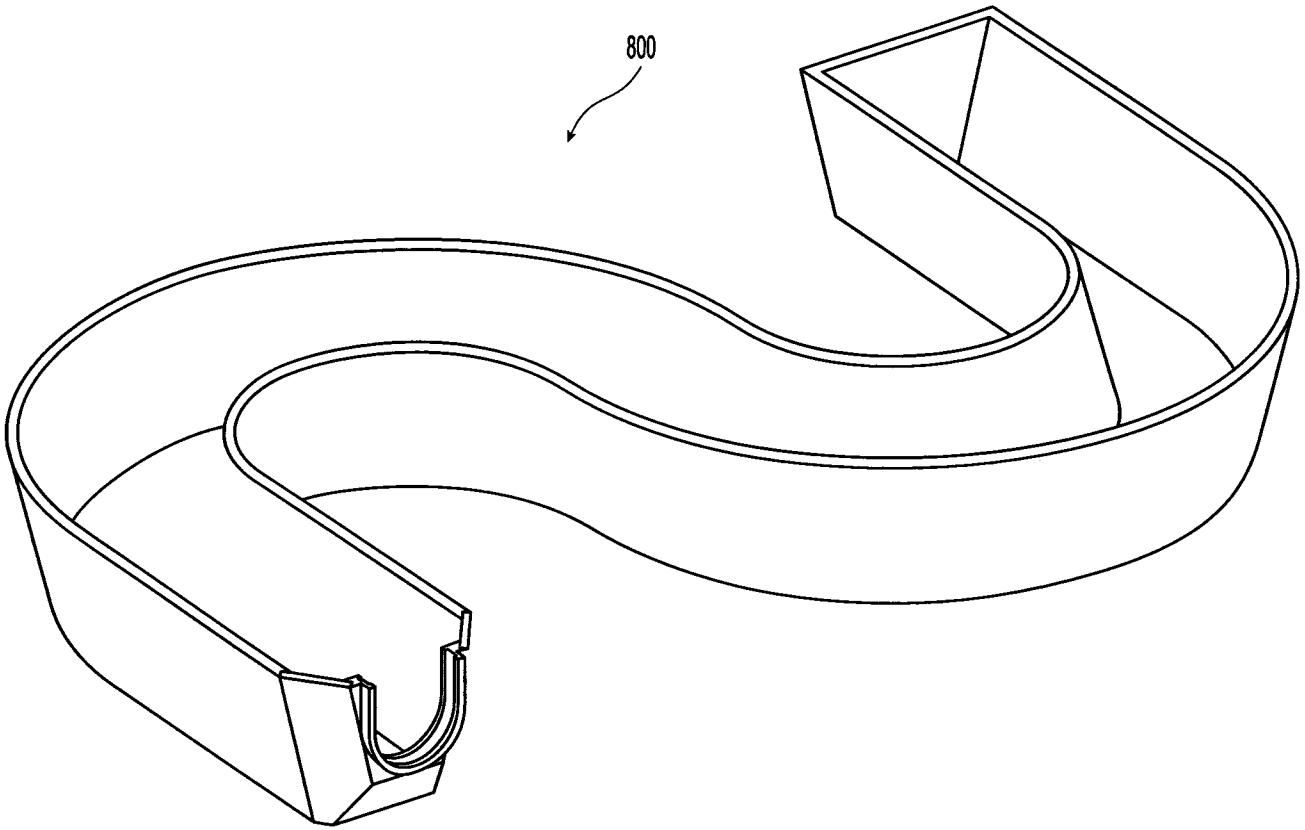
FIG. 8 is a front, perspective view of another embodiment of an ice luge tray configured for use with the ice luge system of FIG. 1.
Figure 9:
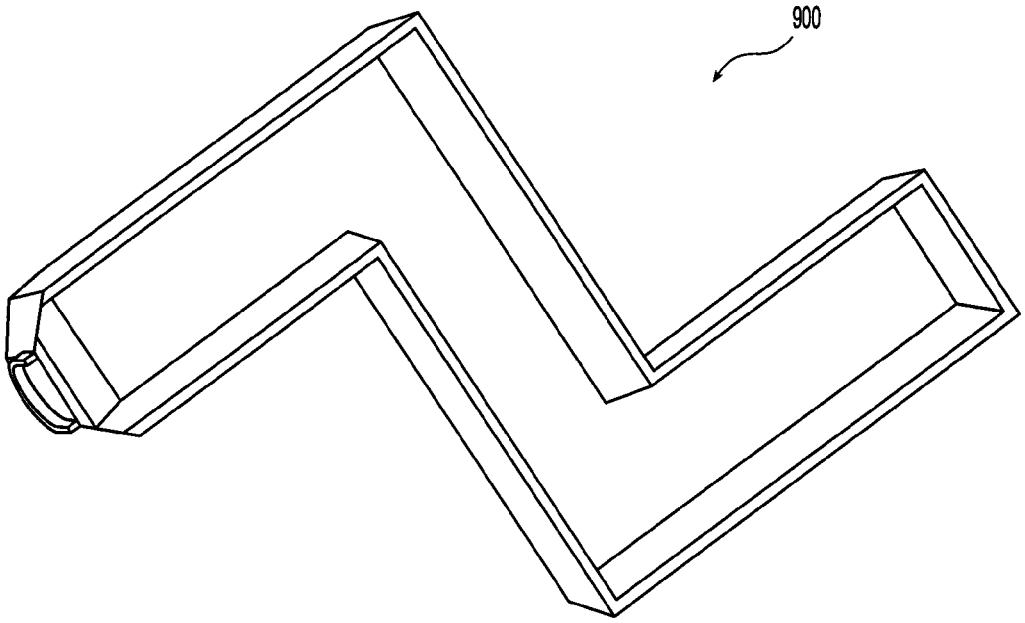
FIG. 9 is a front, perspective view of yet another embodiment of an ice lige tray configured for use with the ice luge system of FIG. 1.
Figure 10:
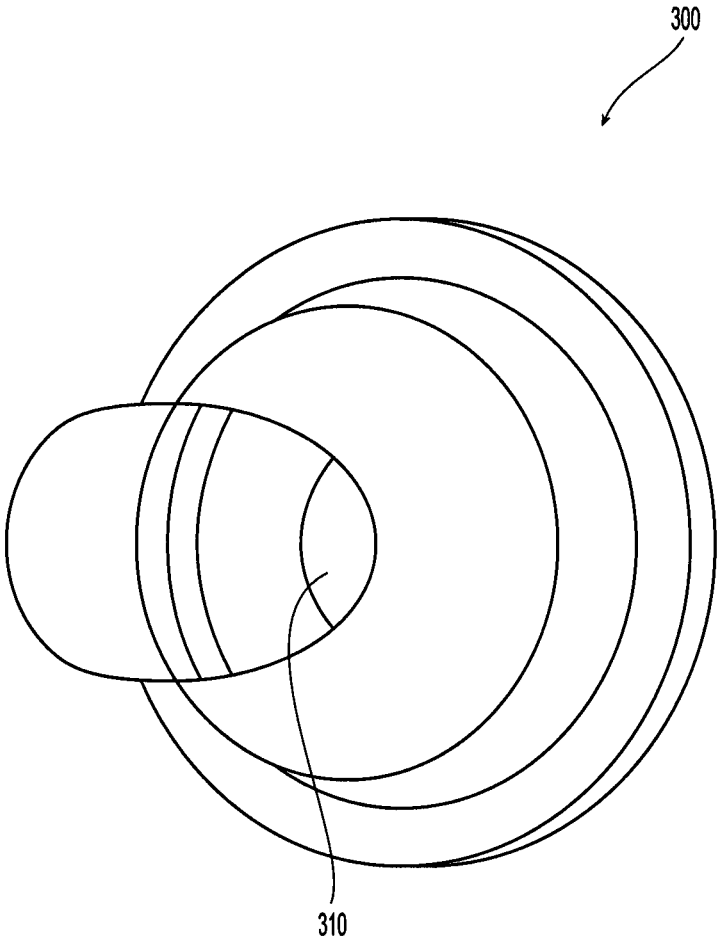
FIG. 10 is a front, perspective view of a spout configured for use with the ice luge system of FIG. 1.

Turning now to FIGS. 8-9, in conjunction with FIG. 5, various different configurations of ice luge trays 800, 900 similar to ice luge tray 200 are shown. As can be appreciated, although only a linear ice luge tray 200, a serpentine-shaped ice luge tray 800, and a zig-zagged ice luge tray 900 are shown, it is contemplated that ice luge trays may be provided in any desirable configuration.

With reference now to FIGS. 1-4 and 10, once the ice blocks are formed within the ice luge trays 200, the ice luge trays 200 can be assembled as described above to achieve a desired configuration. The cut-outs 250 defined within the front walls 230 of the troughs 220, which define the exit port, are positioned to permit beverage to flow through the channel formed within the ice block of the ice luge tray 200, out the exit port, and into the channel of the next ice luge tray 200 under gravity. As such, front walls 230 may define funnel-like configurations for directing the beverage as it exits the ice luge tray 200.

With continued reference to FIGS. 1-4 and 10, spouts 300 may also be provided for releasable engagement, e.g., snap-fit engagement, within the cut-out 250 defined within the front wall 230 of each ice luge tray 200, e.g., in releasable, snap-fit engagement therewith. Spouts 300 each define a generally conical configuration including a lumen 310 extending therethrough that is configured to communicate with the exit port of the ice luge tray 200 to permit passage of the beverage therethrough. The interchangability of the spouts 300 allow each user to have an individual spout 300, thus allowing the user to press his/her mouths and lips up against the spout 300 to surround the lumen 310 for drinking the beverage while reducing the risk of spreading germs and disease. Spouts 300 also eliminate the unpleasantness of pressing ones lips directly against the ice. The spouts 300 may be further configured to redirect, regulate, or refine the flow of the liquid therethrough to facilitate drinking while minimizing spillage.

Figure 11A:
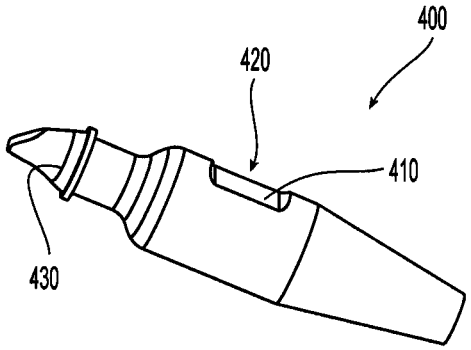
FIG. 11A is a top, perspective view of a dispensing member configured for use with the ice luge system of FIG. 1.
Figure 11B:
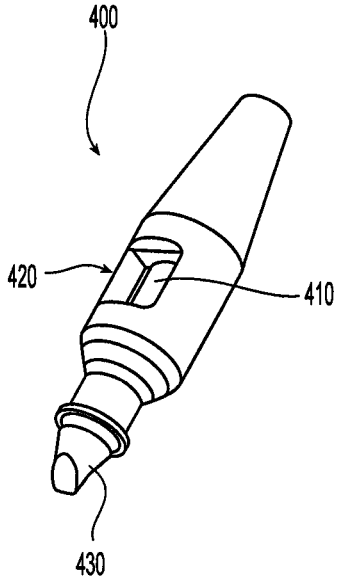
FIG. 11B is a side, perspective view of the dispensing member of FIG. 11A.

As shown in FIGS. 11A-11B, in conjunction with FIGS. 1-4, dispensing members 400 are also provided for use with ice luge system 10. Each dispensing member 400 defines a generally cylindrical-shaped configuration including an internal cavity 410, an upper opening 420 adapted to receive the beverage from the ice luge tray 200, and an exit spout 430 for dispensing the beverage from the internal cavity 410 to a user.

The dispensing member 400 is configured to be suspended from an ice luge tray 200 adjacent the front end thereof, e.g., via a connecting member 440 releasably engagable with clips 280 at one end thereof and pivotably coupled to dispensing member 400 at the other end thereof. That is, dispensing member 400 is pivotably couplable to the connecting member 440 and, thus ice luge tray 200. More specifically, the dispensing member 400 is pivotable relative to the connecting member 440 and, thus, ice luge tray 200 between an idle, or rear-tilting configuration (FIG. 11A), and a use, or forward-tilting configuration (FIG. 11B). The dispensing member 400 is bi-stable, e.g., the dispensing member 400 may be pivoted to and retained, without external bias, in both the idle and use configurations. In the idle configuration, the dispensing member 400 is disposed in rear-tilting position relative to the ice luge tray 200 such that, as the ice blocks melt, the resultant water flows through the channels and ultimately through the upper opening 420 of the dispensing member 400 and into the rear portion of internal cavity 410 of dispensing member 400 (under gravity). In other words, in the idle configuration, dispensing member 400 serves as a runoff receptacle, inhibiting the runoff from spilling onto adjacent furniture or the floor. Alternatively, rather than retaining the fluid in the rear portion of the internal cavity 410, dispensing member 400 may include a rear exit port (not shown) configured to permit the run off to exit the internal cavity via the rear exit port (not shown) and be collected in a waste receptacle (not shown).

In the forward-tilting or use configuration, on the other hand, when beverage flows through the channels of the ice luge trays 300, through the spouts 300, into the upper opening 420, and into the dispensing member 400, the beverage is directed, under gravity, out the exit spout 430 into the awaiting user's mouth (or other suitable beverage container). The exit spout 430 may be releasably coupled to the dispensing member 400 in similar fashion, and for similar purposes, as spouts 300 (FIG. 10) described above, or may be the same as the spouts 300 (FIG. 10) described above, to permit further interchangeability and reduce component count.

From the foregoing and with reference to the figure drawing, those skilled in the art will appreciate that certain modifications can also be made to the present disclosure without departing from the scope of the same. Therefore, the above description should not be construed as limiting, but merely as exemplifications of particular embodiments.

What is claimed is:

1. A system for dispensing a beverage, comprising:

an ice luge tray, comprising:

an open top portion;

a substantially flat bottom, a first angled side wall, a second angled side wall, a rear wall, and a front wall that cooperate to define a trough having a substantially trapezoidal cross-section;

a semicircular opening defined in the front wall configured for selective engagement with a spout;

a lid configured for positioning about the open top portion, the lid comprising a body configured to define a channel extending through an ice block formed within the ice luge tray as water is frozen therein; and a tray engagement member downwardly disposed on the substantially flat bottom;

a support frame comprising a base having at least one support engagement member;

an elongate vertical support member having an upper end configured to operably engage the tray engagement member of the ice luge tray, and a lower end configured to operably engage the at least one support engagement member of the support frame; and a generally cylindrical-shaped dispensing member coupled to the ice luge tray by a connecting member, the cylindrical-shaped dispensing member defining an internal cavity and an upper opening in communication with the internal cavity, the cylindrical-shaped dispensing member adapted to receive a liquid from the ice luge tray, the cylindrical-shaped dispensing member pivotably coupled to the connecting member and movable between a rear-tilting configuration and a forward-tilting configuration such that the cylindrical-shaped dispensing member is bi-stable.

2. The system in accordance with claim 1, wherein the ice luge tray includes a plurality of protrusions extending upwardly from the substantially flat bottom of the ice luge tray and configured to retain the ice block in position within the ice luge tray as the ice block melts.

3. The system in accordance with claim 1, wherein the tray engagement member is further configured to pivotably engage the ice luge tray at an arbitrary angle relative to the elongate vertical support member.

4. The system in accordance with claim 1, wherein the body of the lid is generally cylindrical.

5. The system in accordance with claim 4, wherein the lid further comprises a plurality of arms extending laterally outwardly from sides thereof.

6. The system in accordance with claim 5, wherein at least one of the plurality of arms defines a slot therein that is configured for engagement with an adjacent side wall of the ice luge tray.

7. The system in accordance with claim 1, further comprising the spout, the spout having a generally conical configuration that defines a lumen therethrough, the lumen configured to communicate with the semicircular opening to enable passage of a liquid therethrough.

8. The system in accordance with claim 1, wherein the cylindrical-shaped dispensing member further comprises a forward exit spout in communication with the internal cavity and configured to dispense the liquid from the internal cavity when the cylindrical-shaped dispensing member is in the forward-tilting configuration.

9. The system in accordance with claim 1, wherein the cylindrical-shaped dispensing member further comprises a rear exit spout in communication with the internal cavity and configured to dispense the liquid from the internal cavity when the cylindrical-shaped dispensing member is in the rear-tilting configuration.

10. A system for dispensing a beverage, comprising:

an ice luge tray, comprising:

an open top portion;

a substantially flat bottom, a first angled side wall, a second angled side wall, a rear wall, and a front wall that cooperate to define a trough having a substantially trapezoidal cross-section;

a semicircular opening defined in the front wall configured for selective engagement with a spout;

a lid configured for positioning about the open top portion, the lid comprising a body configured to define a channel extending through an ice block formed within the ice luge tray as water is frozen therein; and a tray engagement member downwardly disposed on the substantially flat bottom;

a support frame comprising a base having at least one support engagement member;

an elongate vertical support member having an upper end configured to operably engage the tray engagement member of the ice luge tray, and a lower end configured to operably engage the at least one support engagement member of the support frame;

a generally cylindrical-shaped dispensing member coupled to the ice luge tray by a connecting member, the cylindrical-shaped dispensing member defining an internal cavity and an upper opening in communication with the internal cavity, the cylindrical-shaped dispensing member adapted to receive a liquid from the ice luge tray, the cylindrical-shaped dispensing member pivotably coupled to the connecting member and movable between a rear-tilting configuration and a forward-tilting configuration, the cylindrical-shaped dispensing member including a rear exit spout in communication with the internal cavity and configured to dispense the liquid from the internal cavity when the cylindrical-shaped dispensing member is in the rear-tilting configuration.

11. The system in accordance with claim 10, wherein the ice luge tray includes a plurality of protrusions extending upwardly from the substantially flat bottom of the ice luge tray and configured to retain the ice block in position within the ice luge tray as the ice block melts.

12. The system in accordance with claim 10, wherein the tray engagement member is further configured to pivotably engage the ice luge tray at an arbitrary angle relative to the elongate vertical support member.

13. The system in accordance with claim 10, wherein the body of the lid is generally cylindrical.

14. The system in accordance with claim 13, wherein the lid further comprises a plurality of arms extending laterally outwardly from sides thereof.

15. The system in accordance with claim 14, wherein at least one of the plurality of arms defines a slot therein that is configured for engagement with an adjacent side wall of the ice luge tray.

16. The system in accordance with claim 10, further comprising the spout, the spout having a generally conical configuration that defines a lumen therethrough, the lumen configured to communicate with the semicircular opening to enable passage of a liquid therethrough.

17. The system in accordance with claim 10, wherein the cylindrical-shaped dispensing member further comprises a forward exit spout in communication with the internal cavity and configured to dispense the liquid from the internal cavity when the cylindrical-shaped dispensing member is in the forward-tilting configuration.

* * * * *